US005145315A

United States Patent [19]

North et al.

[11] Patent Number: 5,145,315

[45] Date of Patent: Sep. 8, 1992

[54] GAS TURBINE VANE COOLING AIR INSERT

[75] Inventors: William E. North, Winter Springs; Kent G. Hultgren, Winter Park; Christopher D. Dishman, Geneva; Gary S. Van Heusden, Oviedo, all of Fla.

[73] Assignee: Westinghouse Electric Corp., Pittsburgh, Pa.

[21] Appl. No.: 766,934

[22] Filed: Sep. 27, 1991

[51] Int. Cl.[5] ..... F01D 5/20

[52] U.S. Cl. ..... 415/115; 415/116; 416/96 A; 29/889.722

[58] Field of Search ..... 416/90 R, 92, 96 A; 415/115, 116; 29/889.722

[56] References Cited

U.S. PATENT DOCUMENTS 3,301,527 5/1965 Kercher ..... 415/115
3,388,888 6/1968 Kercher et al. ..... 415/115
3,475,107 10/1969 Auxier ..... 415/115
3,540,810 3/1966 Kercher ..... 415/115
4,519,745 5/1985 Rosman et al. ..... 416/96 A

*Primary Examiner*—Edward K. Look
*Assistant Examiner*—Michael S. Lee

[57] ABSTRACT

A gas turbine stationary vane is provided having cooling air inserts and an inpingement plate attached to the outer shroud of the vane. The inserts extend only a short distance above their mounting surface on the outer shroud so that there is adequate access for properly welding the inserts to the outer shroud. Insert extensions are disposed in the end of each insert so as to form cooling air inlets which project above the impingement plate. The insert extensions are installed after the insert has been welded to the outer shroud so as to not interfere with access to the weld area. The insert extensions are attached to the inserts and the impingement plate by flexible seal collars, allowing the collars to form positive seals between the components.

17 Claims, 4 Drawing Sheets

GAS TURBINE VANE COOLING AIR INSERT

FIELD OF THE INVENTION

The current invention relates to an insert used to distribute cooling air within a gas turbine vane. More specifically, the current invention concerns an insert having an extension disposed in its distal end which increases the flexibility of the insert and promotes its welding to the vane outer shroud.

BACKGROUND OF THE INVENTION

A gas turbine employs a plurality of stationary vanes, one of which is shown in FIG. 1, circumferentially arranged in rows in its turbine section. Since such vanes are exposed to the hot gas discharging from the combustion section, cooling of these vanes is of utmost importance. Typically, cooling is accomplished by flowing cooling air through cavities, such as cavities 11, 12 and 13 shown in FIG. 2, formed inside the vane airfoil. A tubular insert is disposed in each of these cavities to distribute the air within the cavity. In addition, as shown in FIG. 3, a flat plate-like member 24, referred to as an impingement plate, is attached to the outer shroud of the vane. The impingement plate has a plurality of holes formed therein to promote the formation of jets of cooling air which impinge on the outer shroud.

In order to receive the cooling air directed to the vane, the distal end of at least a portion of the inserts must form an inlet which extends beyond the impingement plate. In the past, the inlet has been created by using a single piece insert which was sufficiently long to extend beyond the impingement plate. However, it is difficult to attach such long inserts to the outer shroud because the projecting end of the insert restricts access to the portion of the insert, referred to as the cover plate, along which the insert must be welded to the shroud. Such welding access is especially restricted in the area of the rear support rail and the raised edges of the outer shroud. This lack of access for welding not only makes fabrication of the vane more costly, it often results in a poor quality weld which is prone to failure. Consequently, it would be desirable to provide an insert having an inlet which extended beyond the impingement plate but which provided sufficient access for welding of the insert to the outer shroud.

In the past, the hole in the impingement plate through which the insert extended was sealed by attaching a seal to the impingement plate which pressed against the insert —that is, the seals formed openings which had a smaller size than that of the insert so that there was an interference fit between the seal and the insert. This approach was necessary because positive sealing by welding the seals directly to both the impingement plate and the inserts was not feasible with the inserts heretofore used in the art. This is so because there was insufficient flexibility in such inserts to withstand the differential thermal expansion between the insert and the impingement plate. As a result, welding a seal to both components would cause cracking of the seals or their welds. Unfortunately, the interference fit between the seal and the insert is sometimes lost after extended operation due to wear and creep, resulting in the leakage of cooling air. Consequently, it would be desirable to provide inserts having sufficient flexibility to allow positive sealing by incorporating seals which were welded to both the impingement plate and the inserts.

SUMMARY OF THE INVENTION

It is an object of the current invention to provide a gas turbine vane having a cooling air insert which can be readily welded to the vane outer shroud.

It is another object of the current invention to provide a cooling air insert having sufficient flexibility to allow welding a seal between the insert and an impingement plate covering a portion of the outer shroud.

These and other objects are accomplished in a gas turbine having a plurality of turbine vanes, each of which is supplied with cooling air and has (i) an airfoil portion forming a first cavity having an insert disposed therein for directing the flow of the cooling air, the insert having first and second distal ends, (ii) an outer shroud portion from which the airfoil portion extends, the insert attached to the outer shroud portion at the first end of the insert, (iii) an insert extension extending through a portion of the insert and extending beyond the first end of the insert, the insert extension and the insert forming an annular gap therebetween separating the insert from the insert extension, (iv) a plate covering at least a portion of the shroud, the plate having a first hole through which the insert extension extends and a plurality of second holes, (v) a first seal collar encircling the insert extension and extending between the insert extension and the insert, the first seal collar having a thickness of approximately 0.13 to 0.25 cm and being welded to both the insert and the insert extension, and (vi) a second seal collar encircling the insert extension and extending between the insert extension and the plate and welded to both, the second seal collar having a thickness of approximately 0.13 to 0.25 cm.

DESCRIPTION OF THE PREFERRED EMBODIMENT

Figure 1:
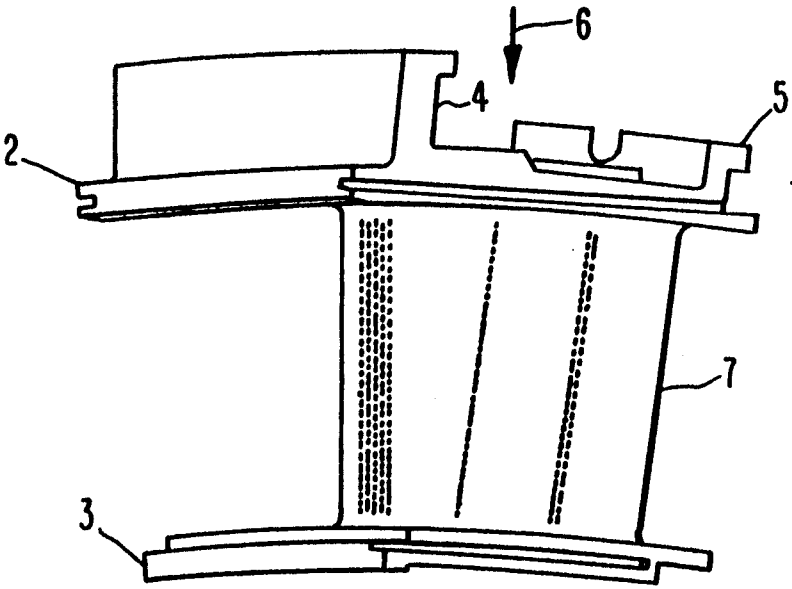
Fig. 1 PRIOR ART
FIG. 1 is an elevation of a gas turbine vane.

There is shown in FIG. 1 a gas turbine vane 1. A plurality of such vanes are circumferentially arranged in a row in the turbine section of the gas turbine and serve to properly direct the flow of hot gas from the combustion section to the rotating blades. The vane 1 shown in FIG. 1 is a first row vane and, thus, is directly exposed to the hot gas discharging from the combustion section. Hence, cooling of such vanes is of utmost importance. The vane 1 is comprised of an airfoil 7 disposed between inner and outer shrouds 2 and 3, respectively. Support rails 4 and 5 are used to attach the vane 1 to an inner cylinder (not shown), referred to as a blade ring.

Figure 2:
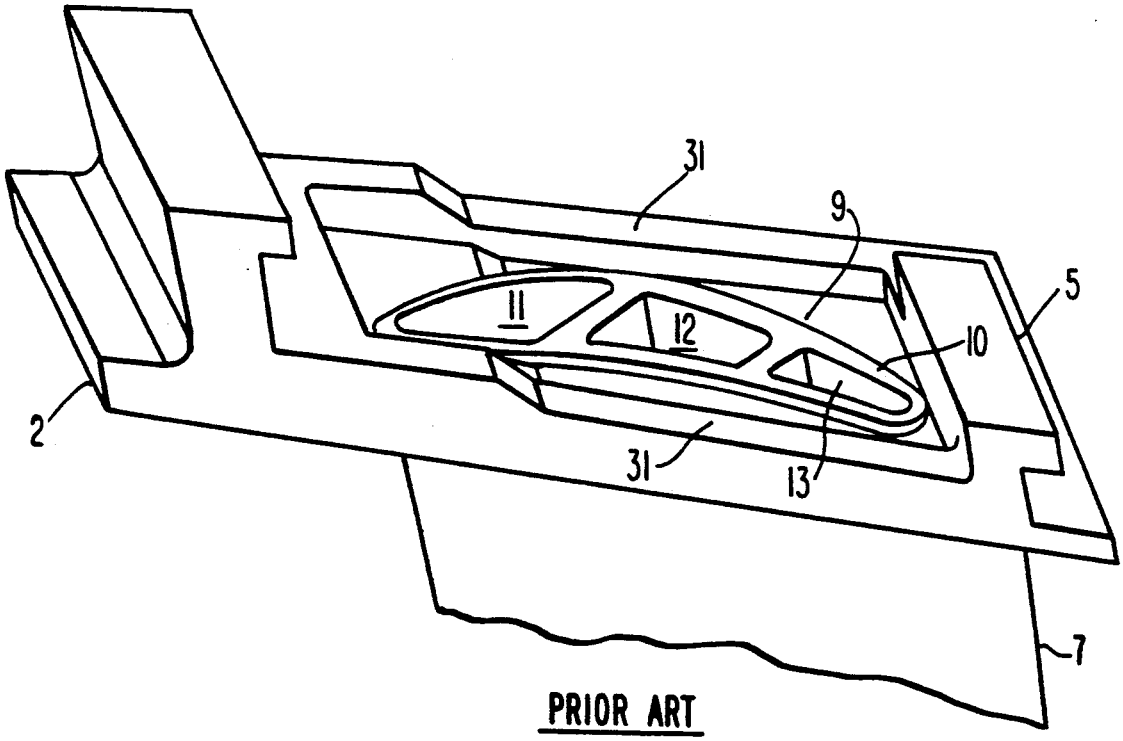
PRIOR ART Fig. 2
FIG. 2 is an isometric view of the outer shroud portion of the vane shown in FIG. 1 before installation of the inserts.
Figure 4:
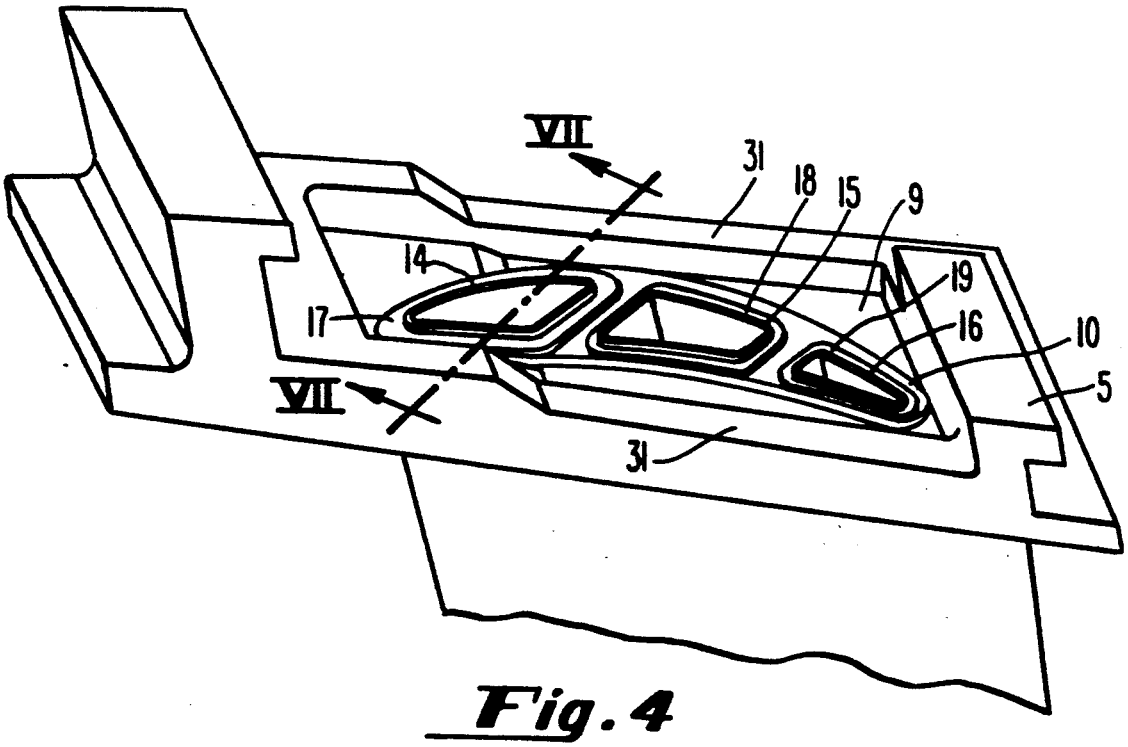
FIG. 4 is a view similar to that of FIG. 2 after the cooling air inserts have been installed
Figure 5:
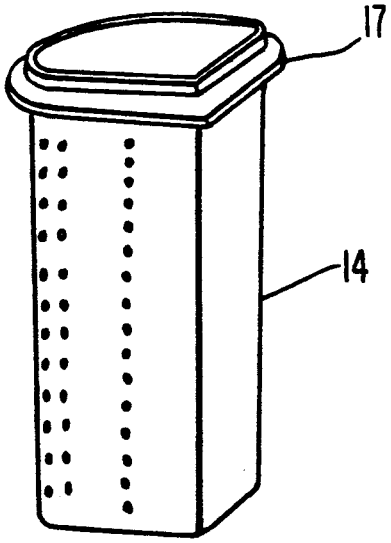
FIG. 5 is an isometric view of one of the inserts shown in FIG. 4.

As shown in FIG. 1, cooling air 6, which may be air extracted from the air discharging from the compressor section, is supplied to the outer shroud 2 of the vane. As shown in FIG. 2, the walls of the airfoil 7 form hollow cavities 11, 12 and 13 in the leading edge, mid-section and trailing edge portions, respectively, of the vane 1. As shown in FIG. 4, inserts 14, 15 and 16 are disposed in these cavities. As shown in FIG. 5, which shows only insert 14 but is illustrative of inserts 15 and 16 as well, the inserts are tubular members which contain a plurality of holes for distributing the cooling air 6 within the cavities, thereby ensuring uniform cooling of the vane 1.

As shown in FIG. 4, cover plates 17, 18 and 19 extend around each of the inserts 14, 15 and 16, respectively, just below their upper end and form flanges for attaching the inserts to the outer shroud 2. A radially outward facing surface 10 formed in the outer shroud 2 serves as an mounting surface for the insert cover plates. The outward facing surface 10 extends upward from a recess 9 formed in the outer shroud 2.

Figure 6:
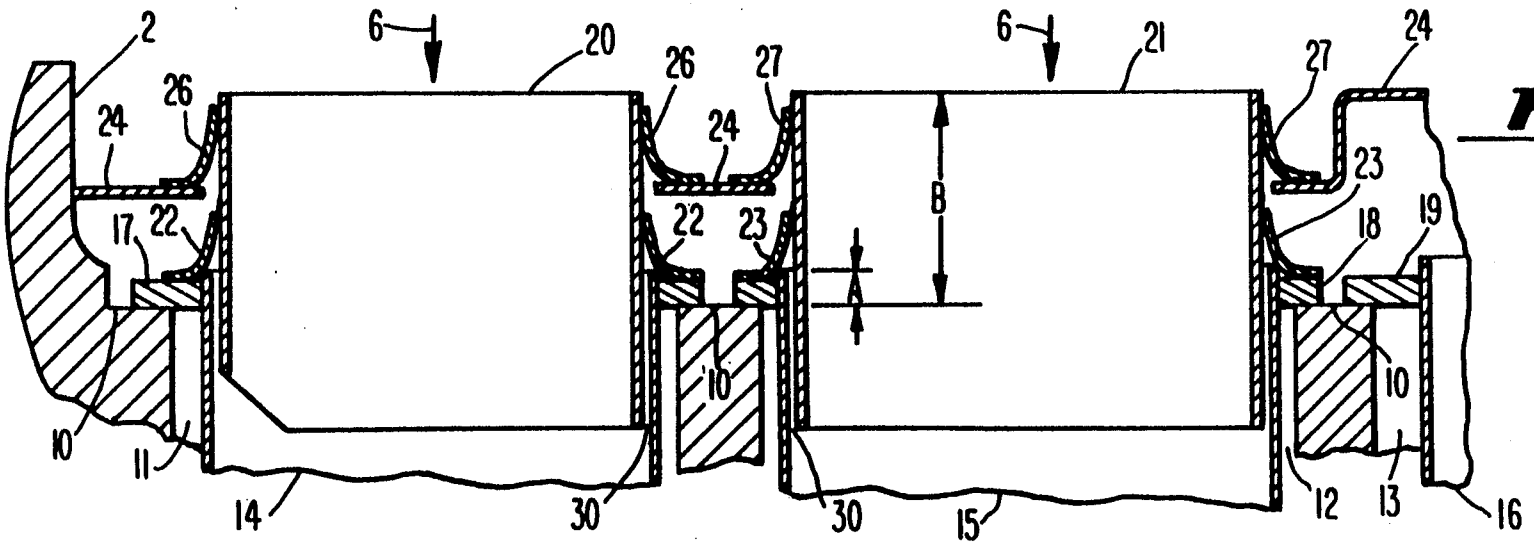
FIG. 6 is a cross-section through line VI—VI shown in FIG. 10.
Figure 7:
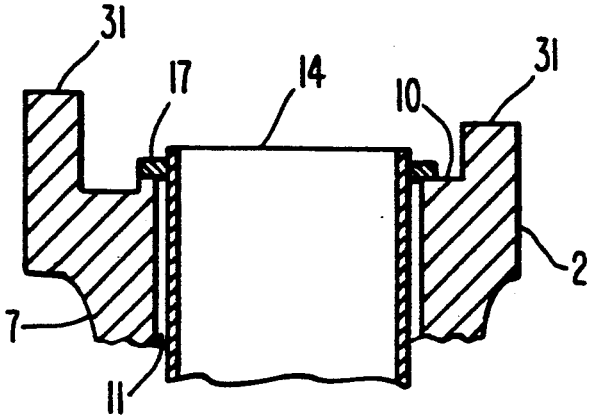
FIG. 7 is a cross-section through line VII—VII shown in FIG. 4.

The inserts 14, 15 and 16 are attached to the outer shroud by welding—for example, by TIG welding—the cover plates 17, 18 and 19 to the mounting surface 10. According to the current invention, the inserts 14, 15 and 16 project only a short distance, shown as dimension A in FIG. 6, above the mounting surface 10. Although the preferred size of dimension A will vary with the size of the vane, in the preferred embodiment of the invention as incorporated into the vane of a large industrial gas turbine, such as that shown in FIG. 1, the dimension A is less than approximately 0.25 cm (0.1 inch). Thus, there is ample access to the cover plate/mounting surface interface to properly apply the weld, even in the vicinity of the raised edges 31 of the outer shroud 2 which project radially outward adjacent the mounting surface 10, as shown in FIG. 7.

Figure 9:
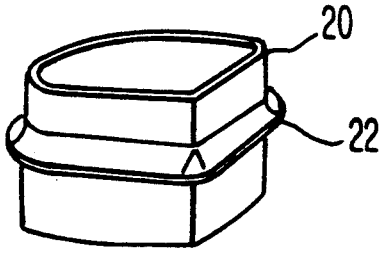
FIG. 9 is an isometric view of one of the insert extensions shown in FIG. 8.
Figure 8:
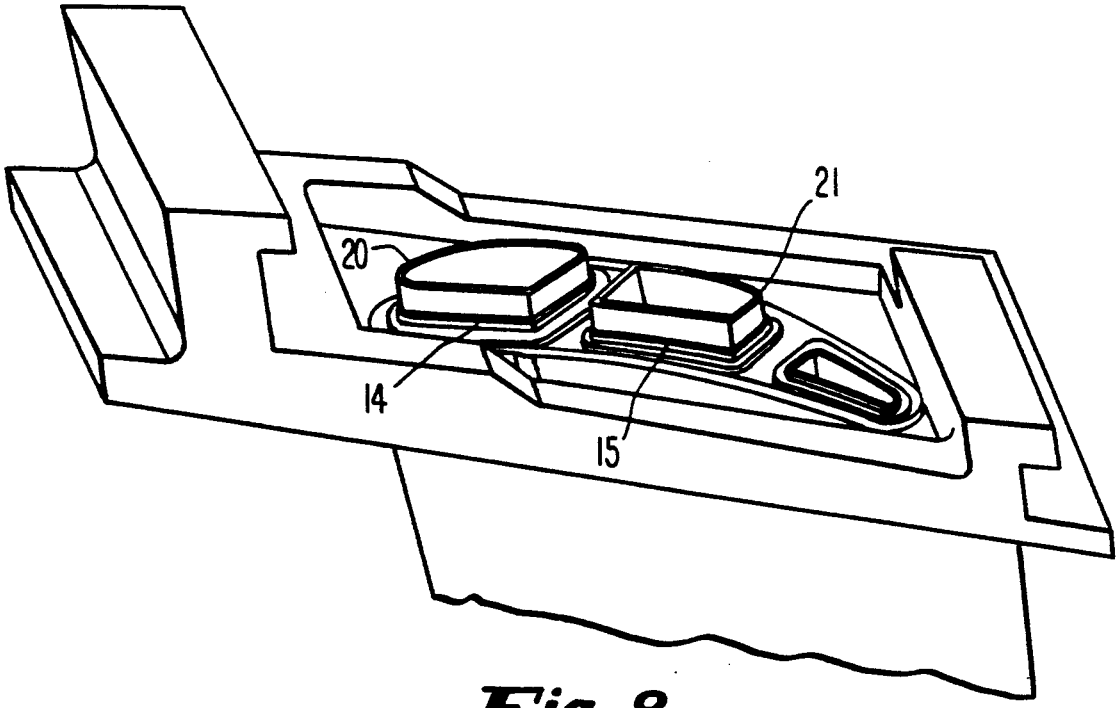
FIG. 8 is a view similar to that of FIG. 4 after the cooling air insert extensions have been installed.

After the inserts 14, 15 and 16 have been installed and the cover plates 17, 18 and 19 welded, insert extensions 20 and 21 are inserted into the end of the inserts 17 and 18, respectively, as shown in FIG. 8. As shown in FIG. 9, which depicts only insert extension 20 but is illustrative of insert extension 21 as well, the insert extensions are short tubular sections. As shown in FIG. 6, the outside cross-sectional dimensions of the insert extensions 20 and 21 are slightly less than the inside cross-sectional dimensions of the inserts 14 and 15, respectively, so that an annular gap 30 is formed between the inserts and the insert extensions. In the preferred embodiment, the annular gap 30 is approximately 0.25 mm (0.010 inch) wide.

As shown in FIG. 6, collars 22 and 23 are welded along their upper edge to the insert extensions 20 and 21, respectively, preferably before the insert extensions are inserted into the inserts. The insert extensions 20 and 21 are then attached to the inserts 14 and 15 by welding the collars 22 and 23 along their lower edge to the cover plates 17 and 18, respectively. Thus, the collars form annular seals extending between the insert extensions and the inserts which prevent cooling air from leaking out of the inserts. Since, in the preferred embodiment, the seal collars 22 and 23 are very thin, preferably 0.13–0.25 mm (5–10 mils), they can be welded to the collars 17 and 18 by spot welding so that gaining access to the weld site after the insert extensions 20 and 21 have been installed is not a problem, as it is when TIG welding the collars 22 and 23 to the outer shroud.

Figure 3:
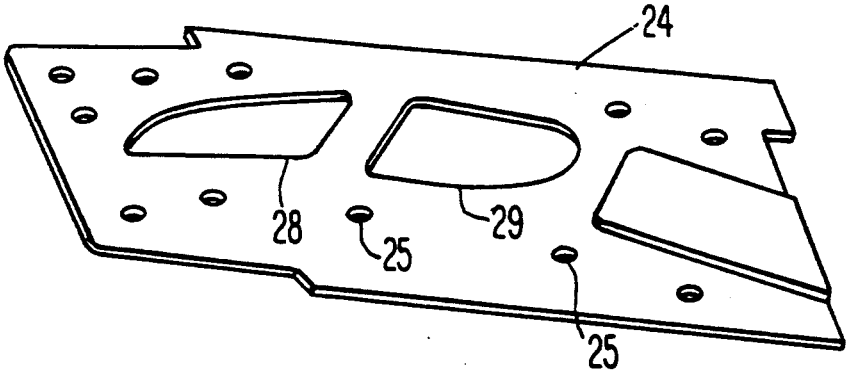
PRIOR ART Fig. 3
FIG. 3 is an isometric view of the impingement plate.
Figure 10:
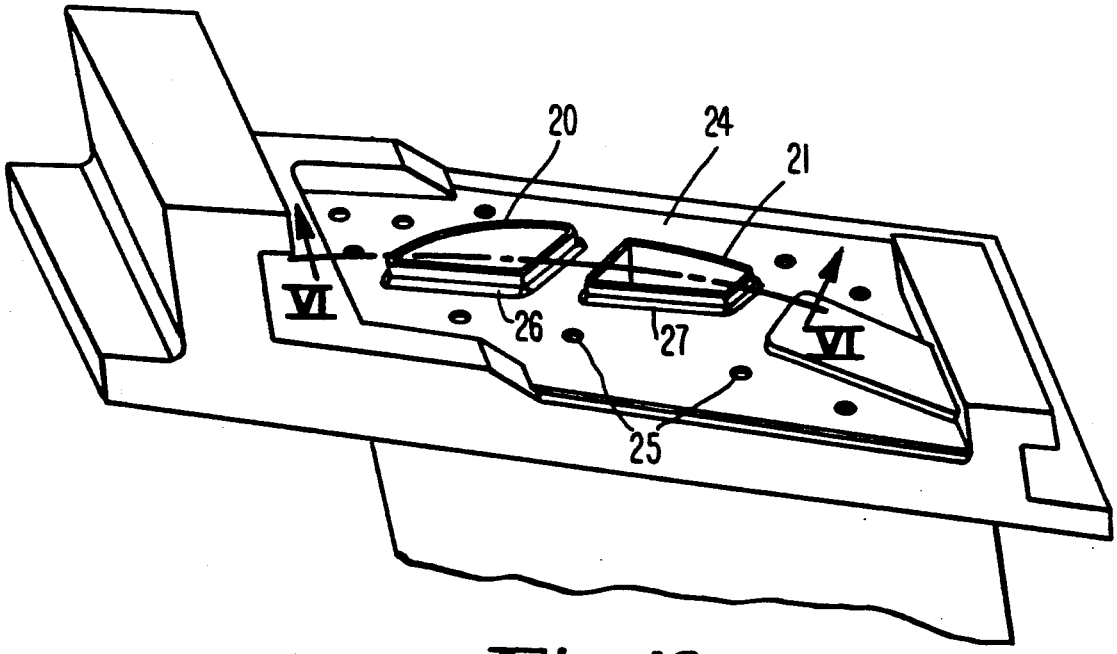
FIG. 10 is a view similar to that of FIG. 8 after the impingement plate has been installed.

After the insert extensions 20 and 21 have been installed, an impingement plate 24, shown in FIG. 3, is placed over the outer shroud 2 so that it covers the recess 9, including the surface 10, as shown in FIG. 10. A plurality of small holes 25 are formed in the impingement plate 24 so that a portion of the cooling air 6 supplied to the outer shroud is formed into jets which impinge with high velocity on the shroud surface, thereby promoting vigorous cooling. As shown in FIG. 6, the insert extensions 20 and 21 are sufficiently long to extend through the large holes 28 and 29 in the impingement plate. Thus, the insert extensions 20 and 21 form cooling air 6 inlets for the inserts 14 and 15.

The insert extensions 20 and 21 extend above the mounting surface 10 by a distance shown as dimension B in FIG. 6. In the preferred embodiment as incorporated into a large industrial gas turbine vane, such as that shown in FIG. 1, the dimension B is at least approximately 1.25 cm (0.5 inch). During fabrication of the vane, the impingement plate 24 is welded along its perimeter to the outer shroud 2. Next, as shown in FIG. 6, seal collars 26 and 27, similar to seal collars 22 and 23, are welded along their upper and lower edges to the insert extensions and the impingement plate, respectively, thereby forming annular seals which prevent the leakage of cooling air.

Thus, unlike the arrangements heretofore known, the cooling air insert arrangement according to the current invention provides cooling air inlets for the inserts 14 and 15 which extend above the impingement plate 24 yet which allow sufficient access for TIG welding the insert cover plates 17 and 18 to the outer shroud 2. This is accomplished by the use of insert extensions 20 and 21 which are installed only after the inserts have been welded to the outer shroud. The insert extension seal collars 22 and 23 are thin enough to allow them to be attached to the insert cover plates 17 and 18 by spot welding so that the limited access to the insert collars which is available once the insert extensions have been installed is not a problem.

Moreover, considerable flexibility is imparted to this insert arrangement by (i) the presence of the gap 30 between the inserts and the insert extensions and (ii) the use of the thin flexible seal collars 22, 23, 26 and 27 to attach the insert extensions to the inserts and the impingement plate. Consequently, differential thermal expansion between the impingement plate 24 and the inserts 14 and 15 does not preclude welding the aforementioned seal collars to these components along both their upper and lower edges so as to form positive seals between the insert extensions and the inserts and between the insert extensions and the impingement plate.

The present invention may be embodied in other specific forms without departing from the spirit or essential attributes thereof and, accordingly, reference should be made to the appended claims, rather than to the foregoing specification, as indicating the scope of the invention.

We claim:

1. A gas turbine comprising a plurality of turbine vanes, each of said vanes supplied with cooling air and having:

a) an airfoil portion forming a first cavity having an insert disposed therein for directing the flow of said cooling air, said insert having first and second insert ends;

b) a shroud portion from which said airfoil portion extends, said insert attached to said shroud portion at said first insert end;

c) an insert extension extending through a portion of said insert and extending beyond said first insert end, said insert extension and said insert forming an annular gap therebetween separating said insert from said insert extension;

d) a plate covering at least a portion of said shroud, said plate having a first hole formed therein through which said insert extension extends; and e) at least a first seal extending between said insert extension and said insert, and sealing said annular gap therebetween.

2. The gas turbine according to claim 1, wherein said first seal is welded to both said insert and said insert extension.

3. The gas turbine according to claim 2, wherein said first seal is spot welded to said insert.

4. The gas turbine according to claim 2, wherein said first seal is a collar encircling said insert extension and having a thickness in the range of approximately 0.13 to 0.25 cm.

5. The gas turbine according to claim 1, wherein each of said vanes further comprises a second seal extending between said insert extension and said plate.

6. The gas turbine according to claim 5, wherein said second seal is welded to both said insert and said plate.

7. The gas turbine according to claim 6, wherein said second seal is a collar encircling said insert extension and having a thickness in the range of approximately 0.13 to 0.25 cm.

8. The gas turbine according to claim 5, wherein said plate has a plurality of second holes formed therein adapted to form at least a portion of said cooling air into a plurality of jets which impinge upon said shroud.

9. The gas turbine according to claim 8, wherein said shroud is an outer shroud.

10. A gas turbine comprising a plurality of turbine vanes, each of said vanes having:

a) an airfoil portion;

b) an outer shroud portion attached to said airfoil portion and having a radially outward facing surface and a radially outward projecting portion adjacent said surface;

c) a first tubular insert disposed in said airfoil and attached to said outer shroud at said surface, said first tubular member projecting above said surface a first predetermined distance; and d) a second tubular insert having first and second distal ends and partially enclosed by said first tubular insert, said first distal end extending a second predetermined distance above said surface.

11. The gas turbine according to claim 10, wherein said first predetermined distance is less than approximately 0.25 cm (0.1 inch).

12. The gas turbine according to claim 11, wherein said second predetermined distance is at least approximately 1.25 cm (0.5 inch).

13. The gas turbine according to claim 10, wherein each of said vanes further comprises a plate covering at least a portion of said surface, said second tubular insert extending above said plate.

14. The gas turbine according to claim 13, wherein each of said vanes further comprises:

a) a first flexible seal extending between said plate and said second tubular inserts; and b) a second flexible seal extending between said first and second tubular inserts.

15. A method of making a gas turbine, comprising the steps of:

a) welding a first tubular insert adjacent its first end to a vane outer shroud;

b) partially inserting a second tubular insert into said first tubular member and attaching said second tubular insert thereto;

c) placing a plate having a hole formed therein on said outer shroud so that said hole surrounds said second tubular insert; and d) attaching said second tubular insert to said plate by placing a first seal between said first and second tubular inserts and attaching said first seal to each of said first and second tubular inserts, and placing a second seal between said second tubular insert and said plate and welding said second seal to said second tubular insert and said plate.

16. The method according to claim 15, wherein the step of attaching said first seal to said second tubular insert comprises the step of spot welding said first seal to said second tubular insert.

17. The method according to claim 16, wherein the step of welding said first tubular insert adjacent its first end to said vane outer shroud comprises the step of TIG welding said first tubular insert to said vane outer shroud.

* * * * *